US006883566B2

(12) United States Patent
Dirnberger et al.

(10) Patent No.: US 6,883,566 B2
(45) Date of Patent: Apr. 26, 2005

(54) RAIN PROTECTION DEVICE FOR A GOLF BAG

(76) Inventors: Adolf Dirnberger, Benzstrasse 5, DE-92245 Kümmersbruck (DE); Hans-Dieter Henschel, Terrassenweg 8, DE-92224 Amberg (DE)

( * ) Notice: Subject to any disclaimer, the term of this patent is extended or adjusted under 35 U.S.C. 154(b) by 0 days.

(21) Appl. No.: 10/169,693

(22) PCT Filed: Jan. 3, 2001

(86) PCT No.: PCT/DE01/00062

§ 371 (c)(1),
(2), (4) Date: Jul. 3, 2002

(87) PCT Pub. No.: WO01/51136

PCT Pub. Date: Jul. 19, 2001

(65) Prior Publication Data

US 2003/0000614 A1 Jan. 2, 2003

(30) Foreign Application Priority Data

Jan. 13, 2000 (DE) ..... 200 00 471 U

(51) Int. Cl.[7] ..... B65D 65/02
(52) U.S. Cl. ..... 150/159; 206/315.6; 2/93
(58) Field of Search ..... 100/159, 160, 100/154, 113; 206/315.4, 315.5, 315.3; 224/918, 919, 576, 577; 190/110; 2/93, 94

(56) References Cited

U.S. PATENT DOCUMENTS

| | | | | |
|---|---|---|---|---|
| 2,462,269 A | * | 2/1949 | Krempel | 2/84 |
| 2,747,637 A | | 5/1956 | Brown | |
| 2,971,198 A | * | 2/1961 | Tomich | 2/84 |
| 4,060,852 A | * | 12/1977 | Meeks | 2/84 |
| 4,138,742 A | * | 2/1979 | Meeks | 2/84 |
| 4,350,194 A | * | 9/1982 | Brown | 206/315.5 |
| 5,099,897 A | | 3/1992 | Curtin | |
| 5,176,253 A | * | 1/1993 | Perrin et al. | 206/315.5 |
| 5,407,112 A | * | 4/1995 | Christodoulou et al. | 224/153 |
| 5,407,723 A | | 4/1995 | Curtin | |
| 5,443,156 A | | 8/1995 | Shioda | |
| 5,490,594 A | | 2/1996 | Rupe | |
| 5,564,125 A | * | 10/1996 | Waldman et al. | 2/93 |
| 5,718,333 A | | 2/1998 | Armour | |
| 5,904,247 A | | 5/1999 | Voelkner, Jr. | |
| 6,134,712 A | * | 10/2000 | Spector | 2/94 |

FOREIGN PATENT DOCUMENTS

| | | |
|---|---|---|
| FR | 720.869 | 2/1932 |
| GB | 1277431 | 6/1972 |

OTHER PUBLICATIONS

K–Way, Once upon a time in the north. . ., K–Way Web page dated Oct. 25, 2002.

* cited by examiner

*Primary Examiner*—Lien Ngo
(74) *Attorney, Agent, or Firm*—Bachman & LaPointe, P.C.

(57) ABSTRACT

A rain protection arrangement for a golf bag (10), which has a rain protection cover (30) which can be folded up in a small volume, in a storage compartment. The storage compartment is in the form of a bag (24) which can temporarily secured to the golf bag (10) by means of a fixing device (26). The rain protection cover (30) is fixedly connected to the bag (24) along a fixing portion.

12 Claims, 3 Drawing Sheets

RAIN PROTECTION DEVICE FOR A GOLF BAG

BACKGROUND OF THE INVENTION

The invention concerns a rain protection arrangement for a golf bag, which has a rain protection cover which can be folded up in a small volume, in a storage compartment.

Golf bags in various different design configurations are known from the prospectus "BULLET GOLF, THERE IS NOTHING BETTER—INNOVATIVE GOLF EQUIPMENT". A golf bag with a rain protection cover which can be folded up in a small volume, in a storage compartment, is known by the name "EXECUTIVE 9.5'", wherein the storage compartment is an integral component of the golf bag. This means that, as is known, a rain protection arrangement belongs to the respective golf bag. Such golf bags with an integrated rain protection cover are relatively expensive to buy. If a golfer wants a new golf bag, either he must again buy a correspondingly costly golf bag with integrated rain protection cover or he must buy a golf bag without such a rain protection arrangement. In the latter case therefore the golfer then has a golf bag without a rain protection arrangement, which is also to be viewed as a disadvantage.

The object of the present invention is to provide a rain protection arrangement of the kind set forth in the opening part of this specification, which can be combined easily and without any problem with any golf bag, in order to protect the respective golf bag from the influences of weather such as rain or the like.

SUMMARY OF THE INVENTION

In accordance with the invention, in a rain protection arrangement of the kind set forth in the opening part of this specification, that object is attained in that the storage compartment is in the form of a bag which can temporarily secured to the golf bag by means of a fixing device, wherein the rain protection cover is fixedly connected to the bag along a fixing portion.

The rain protection arrangement according to the invention has the advantage that the bag which contains the rain protection cover can be fixed to any desired golf bag by means of its fixing device in a simple and time-saving manner and if necessary can also be removed from the corresponding golf bag again so that if desired the bag can be temporarily fixed to another golf bag, for example to the bottom end portion thereof.

The fixing portion, along which the rain protection cover is fixedly connected to the bag, is desirably disposed in the interior of the bag so that it is easily possible for the rain protection cover to be disposed, in a condition of being folded down into a small volume, in the bag, and to close the bag.

If the respective golf bag is to be protected from the influences of weather such as rain or the like, the bag which is temporarily secured to the golf bag only needs to be opened in order then to pull the rain protection cover which has been folded into a small volume, out of the bag, and to fit from below upwardly over the golf bag.

The fixing device, by means of which the bag containing the rain protection cover can be temporarily secured to the respective golf bag can be for example in the form of a belt, a fixing strap or the like, so that the bag containing the rain protection cover can be secured to the respective golf bag. It is desirable in that respect if the bag is temporarily secured to the bottom end portion of the golf bag in order to permit virtually protection on all sides for the golf bag from the influences of the weather.

The bag of the rain protection arrangement according to the invention can comprise a main bag portion and a closure portion for closing the main bag portion by means of a closure device. The main bag portion and the closure portion can be produced by connecting seams, welded seams or by means of other per se known technologies. The technology which is respectively employed depends on the material of the main bag portion and the closure portion.

The bag, that is to say the main bag portion and the closure portion, advantageously comprise a material which is impermeable to moisture.

The closure device provided for closing the main bag portion with the closure portion can be formed by a zip closure or a hook-and-loop closure. It is likewise possible for the closure portion to be in the form of a closure flap which overlaps the main bag portion in the closed condition in order to prevent for example rain water from penetrating into the interior of the storage bag. That overlap can be temporarily fixed for example by at least one press stud, a buckle or clasp closure, a zip closure or a hook-and-loop closure.

The rain protection cover desirably comprises a crease-resistant or non-crease material which is impermeable to moisture. In that respect, by virtue of a suitable choice of material, it is possible to avoid crease folds in the rain protection cover, which are unsightly in the active rain-protective condition. Decorative effects can be achieved by particular coloring of the material.

It is desirable if the rain protection cover of the rain protection arrangement according to the invention is provided with a closure flap portion which can be sealingly connected to the rain protection cover by means of a closure device. In that way it is reliably possible for the golf bag or the golfing equipment items such as golf clubs which are in the golf bag to be sealingly covered. The closure device is for example a zip closure.

The same purpose, that is to say protecting the golf bag or the golf equipment items in the golf bag from the influences of weather such as rain can be served if the rain protection cover can be closed along two longitudinal edges. Such a configuration of the last-mentioned kind affords reliable protection in particular for the golf bag even at its rear side which is away from the rain.

To close the rain protection cover, a zip closure or a hook-and-loop closure can be provided at both longitudinal edges. Another possibility provides arranging press studs or buckle or clasp closures at the two longitudinal edges.

Independently of the respective specific configuration, there is the advantage that the rain protection arrangement according to the invention can be fitted to any golf bag, that is to say it can be combined with any desired golf bag in order reliably to protect it from the influences of weather such as rain. That applies not only in regard to the respective golf bag but in the same manner in regard to the golfing equipment items in the respective golf bag.

BRIEF DESCRIPTION OF THE DRAWINGS

Further details, features and advantages will be apparent from the description hereinafter of an embodiment, illustrated in the drawing, of the rain protection arrangement according to the invention and a golf bag with a rain protection arrangement according to the invention. In the drawing.

DETAILED DESCRIPTION

Figure 1:
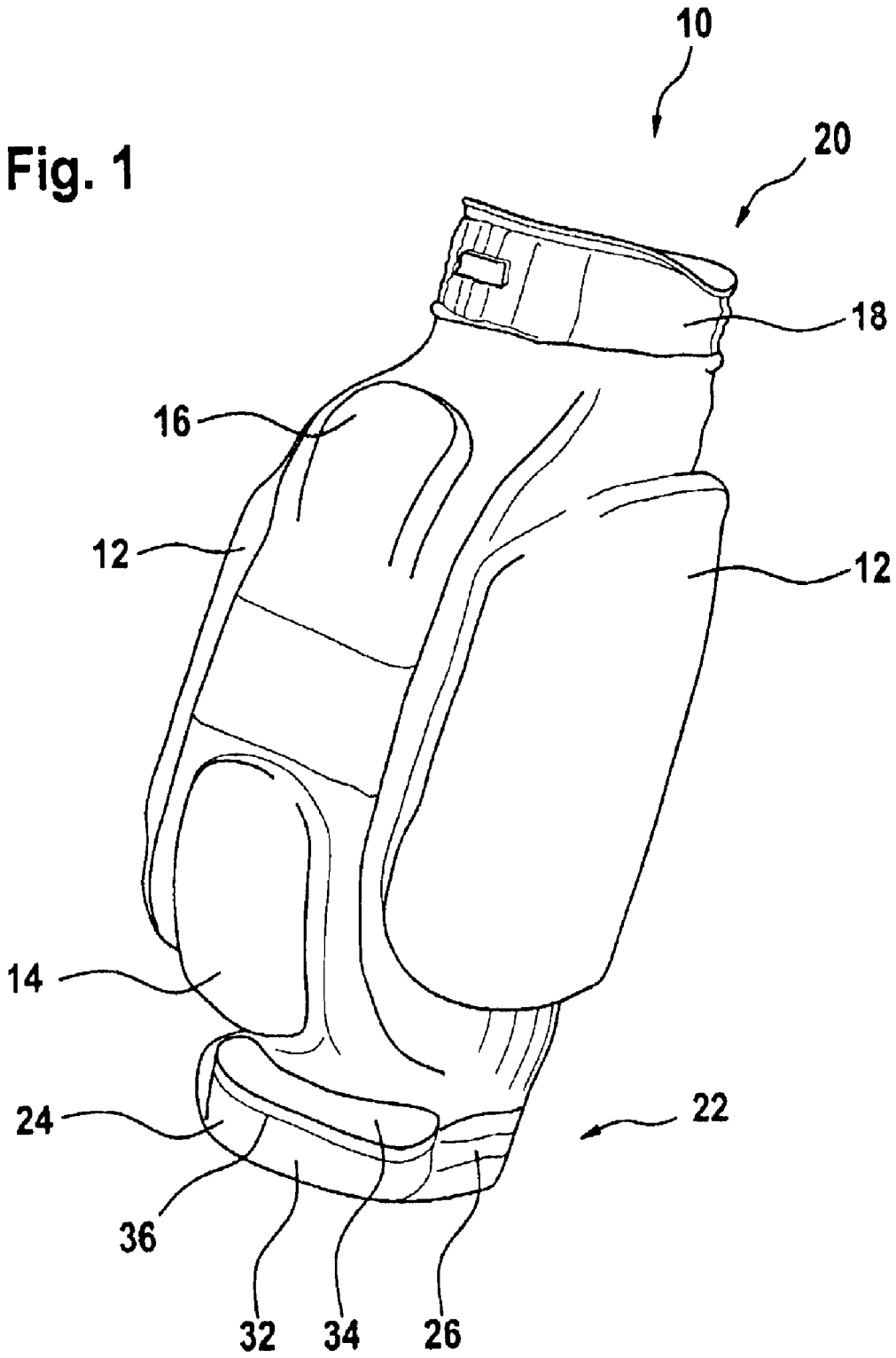
FIG. 1 shows a perspective view of a golf bag with a rain protection arrangement in its inactive rest or storage condition, which is temporarily fitted to the golf bag.

FIG. 1 is a perspective view inclinedly from the front showing a golf bag 10 with pockets 12, 14 and 16 for various items of golfing equipment. The golf bag 10 has a peripherally extending collar portion 18 at its top end, which defines an opening 20 of the golf bag 10. Items of golfing equipment such a golf clubs can be put into the golf bag 10 through the opening 20.

A bag 24 is temporarily secured by means of a fixing device 26 to the lower end portion 22 of the golf bag 10, the lower end portion 22 being stable in respect of shape. The fixing device 26 is formed for example by a fixing belt which is connected to the bag 24 and which projects therefrom and which has for example a belt clasp or buckle 28 (see FIG. 3) in order to be able to releasably fix the bag 24 to the bottom end portion 22 of the golf bag 10.

Figure 2:
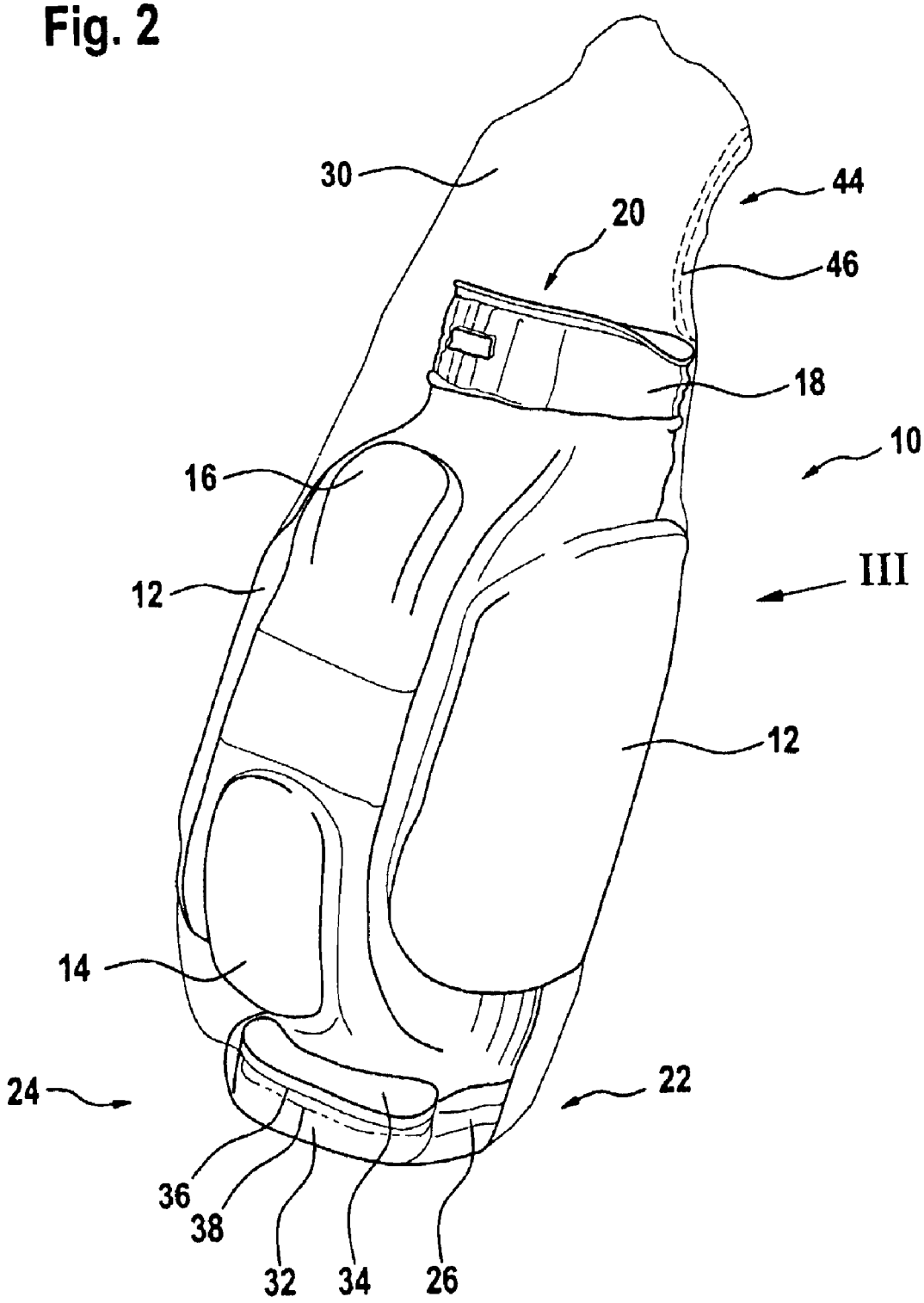
FIG. 2 is a view similar to FIG. 1 showing the golf bag with the rain protection arrangement in its active position of use, that is to say its rain-protective condition.

The bag 24 forms a storage compartment for a rain protection cover which can be folded down into a small volume and which is shown in FIG. 2 in its active condition of use of covering the golf bag 10. In the inactive condition in which it is not in use, the rain protection cover 30 can be disposed in the bag 24 in the condition of being folded into a small volume.

The bag 24 has a main bag portion 32 and a closure portion 34. The fixing device 26 projects from the main bag portion 32. Provided between the main bag portion 32 and the closure portion 34 is a closure device 36 which is formed for example by a zip closure or a hook-and-loop closure.

The rain protection cover 30 which comprises a crease-resistant or non-crease material which is impermeable to moisture is connected in the interior of the bag 24 along a fixing portion 38 to the bag 24 or the main bag portion 32 thereof (see FIG. 2).

Figure 3:
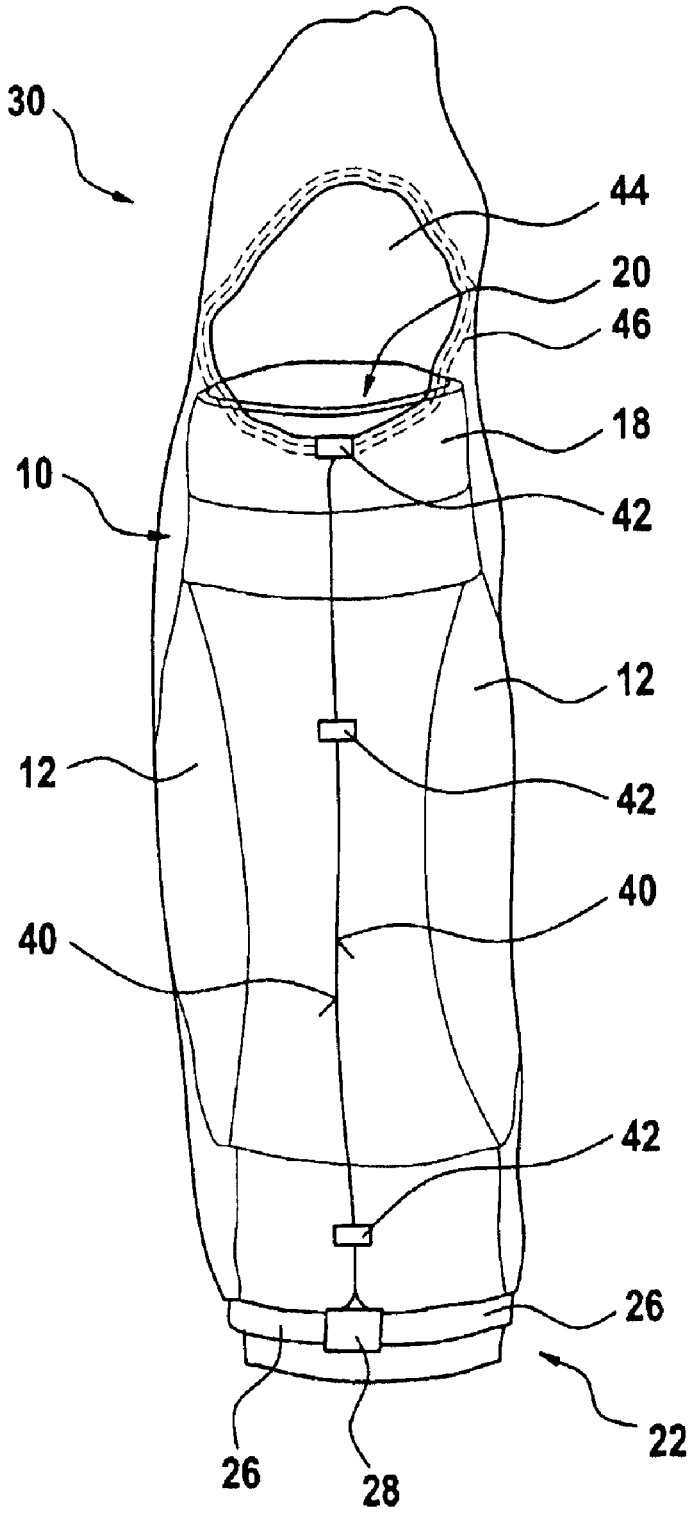
FIG. 3 shows a view of the golf bag with the rain protection arrangement viewing in the direction of the arrow III in FIG. 2, that is to say viewing onto the rear side of the golf bag.

As can be seen from FIG. 2 and in particular FIG. 3, the rain protection cover 30 can be closed along its two longitudinal edges 40 adjoining the fixing portion 38. For that purpose, press studs or clasp or buckle closures 42 can be provided at those longitudinal edges 40. Likewise it is possible to provide a zip closure or a hook-and-loop closure at the two longitudinal edges 40 in order to connect the longitudinal edges 40 to each other in such a way that virtually a cowl opening 44 remains in the region of the opening 20 at the upper end of the golf bag 10. Along the edge of that cowl opening 44 the rain protection cover 30 is provided with an elastic element which is for example in the form a piece of elastic.

The cowl opening 44 provides that, even when the rain protection cover 30 is in the active condition of use, it is possible for items of golfing equipment such as golf clubs to be put into or removed from the golf bag 10. At the same time the rain protection cover 30 affords excellent protection for the golf bag 10 or the items of golfing equipment such as golf clubs 30 which are in the golf bag 10.

What is claimed is:

1. A combination comprises a golf bag and a storage compartment for a rain protection cover, the golf bag comprises an upper collar portion defining an opening and a bottom end portion, the storage compartment comprises a storage bag having an exterior portion and an interior portion, means on the exterior portion of the storage bag for securing the storage bag to the golf bag, means on the interior of the storage bag for fixedly connecting the rain protection cover to the storage bag wherein, in a first portion the rain protection cover is folded to a small volume within the storage bag and in a second position encloses at least a portion of the golf bag while allowing access to the opening defined by the upper collar portion of the golf bag, and the rain protection cover includes closure means for closing the rain protection cover around the portion of the golf bag when in the second position.

2. The combination as set forth in claim 1, wherein the means for securing the storage bag secures the storage bag to the bottom end portion of the golf bag.

3. The combination as set forth in claim 2, wherein the bottom end portion is of a material which forms a stable shape.

4. The combination as set forth in claim 1, wherein the means for securing includes means for removably securing the storage bag to the golf bag.

5. The combination as set forth in claim 2, wherein the means for securing includes means for removably securing the storage bag to the golf bag.

6. The combination as set forth in claim 1, wherein the storage bag has a main bag portion and a closure portion for closing the main bag portion by means of a closure device.

7. The combination as set forth in claim 6, wherein the closure device is formed by a zip closure or a hook-and-loop closure.

8. The combination as set forth in claim 1, wherein the storage bag comprises a material which is impermeable to moisture.

9. The combination as set forth in claim 1, wherein the rain protection cover comprises a crease-resistant or non-creases material which is impermeable to moisture.

10. The combination as set forth in claim 1, wherein the rain protection cover is closable along two longitudinal edges.

11. The combination as set forth in claim 10, wherein one of a zip closure and a hook-and-loop closure is provided at the two longitudinal edges.

12. The combination as set forth in claim 10, wherein one of press studs and clasp closures are provided at the two longitudinal edges.

* * * * *